US009021995B2

(12) United States Patent
Golz

(10) Patent No.: US 9,021,995 B2
(45) Date of Patent: May 5, 2015

(54) ELECTROMAGNETIC ACTUATING DEVICE AND CAMSHAFT ADJUSTER

(75) Inventor: Thomas Golz, Sipplingen (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 14/127,993

(22) PCT Filed: Jun. 15, 2012

(86) PCT No.: PCT/EP2012/061437

§ 371 (c)(1),
(2), (4) Date: Dec. 20, 2013

(87) PCT Pub. No.: WO2012/175421

PCT Pub. Date: Dec. 27, 2012

(65) Prior Publication Data

US 2014/0137820 A1 May 22, 2014

(30) Foreign Application Priority Data

Jun. 22, 2011 (DE) ..... 10 2011 051 268

(51) Int. Cl.

| | |
|---|---|
| ***F01L 9/04*** | (2006.01) |
| ***H01H 50/54*** | (2006.01) |
| ***F01L 25/08*** | (2006.01) |
| ***F01L 1/34*** | (2006.01) |
| ***H01F 7/16*** | (2006.01) |
| ***F01L 13/00*** | (2006.01) |
| ***F01L 1/46*** | (2006.01) |

(Continued)

(52) U.S. Cl.

CPC ..... *H01H 50/54* (2013.01); *F01L 25/08* (2013.01); *F01L 2009/0428* (2013.01); *F01L 1/34* (2013.01); *H01F 7/1646* (2013.01); *F01L 13/0036* (2013.01); *F01L 2013/0052* (2013.01); *F01L 1/46* (2013.01)

(58) Field of Classification Search

CPC ..... F01L 25/08; F01L 2009/0428

USPC ..... 123/90.11, 90.16; 251/129.01

See application file for complete search history.

(56) References Cited

U.S. PATENT DOCUMENTS 8,362,861 B2 * 1/2013 Martin et al. ..... 335/255

FOREIGN PATENT DOCUMENTS

| | | |
|---|---|---|
| DE | 199 00 995 | 8/1999 |
| DE | 20 2007 010 814 | 1/2008 |
| DE | 2006 011 905 | 1/2008 |
| DE | 20 2007 005 133 | 9/2008 |

(Continued)

OTHER PUBLICATIONS

International Search report dated Sep. 21, 2012, (for PCT/EP2012/061437).

*Primary Examiner* — Ching Chang

(74) *Attorney, Agent, or Firm* — Bachman & LaPointe, PC

(57) ABSTRACT

The invention relates to an electromagnetic actuating device (1) for a camshaft adjustment device of an internal combustion engine of a motor vehicle, with an elongated actuating element (2) forming an engagement region on the end side and movable by the force of a coil device (29) provided in a stationary manner, which actuating element preferably has in parts a cylindrical covering contour and penetrates a cut-out (8) in permanent magnet means (6) arranged on the shell side, which are constructed for cooperating with a stationary core region (5) comprising a core body (15), and which actuating element lies in a switching position with a contact surface (11), on the end side on the actuating element side, against a contact surface (10) on the core region side. Provision is made that the contact surface (11) on the core region side is formed at least in part by a contact element (16) fixed in the core body (15), which contact element is constructed from a material which has a greater hardness than the material of the core body (15).

20 Claims, 3 Drawing Sheets

(56) References Cited

FOREIGN PATENT DOCUMENTS

| | | |
|---|---|---|
| DE | 20 2009 001 187 | 7/2010 |
| DE | 20 2011 001 412 | 6/2012 |
| EP | 0 428 728 | 5/1991 |
| WO | 2008/014996 | 2/2008 |

* cited by examiner

ELECTROMAGNETIC ACTUATING DEVICE AND CAMSHAFT ADJUSTER

BACKGROUND OF THE INVENTION

The invention relates to an electromagnetic actuating device and a camshaft adjustment device with such an electromagnetic actuating device as actuator.

In known electromagnetic actuating devices for adjusting the camshaft, the problem exists that owing to the geometry of the core region and of the armature, due to magnet technology, in the currentless state, an adhesion force acts between the core region of the actuating member of the armature. This adhesion force is intensified by the oil, situated in the adjustment unit, which collects between the contact surfaces of core region and actuating member. The adhesion force which thereby arises acts in particular in the low- and deep temperature range (+10° C. to −40° C.) negatively on the switching times of the electromagnetic adjustment unit. A lengthy idle time of the vehicle can also lead to an intensification of the adhesion force.

In order to reduce the above-mentioned disadvantages, an improved electromagnetic actuating device for adjusting a camshaft in a motor vehicle, described in WO 2008/014996 A1, was developed by the applicant. From the publication, it is known to reduce the adhesion force between the actuating member and the core region, caused by lubricant, in that a slit-shaped recess and/or notch, i.e. depression, is provided in the end face of the actuating member.

The reduction of the contact surfaces between actuating member and core region, proposed by the applicant, involves a distinctly increased surface pressure and hence an increased material stress of the core body of the core region. Attempts exist to improve the wear resistance of the actuating device with, at the same time, a reduced adhesion force. Preferably, at the same time, the efficiency of the actuating device is to be improved.

From DE 20 2007 010 814 U1 and DE 20 2009 001 187 U1 electromagnetic actuating devices are known, which comprise an actuating element which forms an engagement region on the end side and which penetrates a cut-out in permanent magnet means which are arranged on the shell side.

From EP 0 428 728 A1 an electromagnetic actuating device is known, which has an actuating element without permanent magnet means, wherein the actuating device is equipped with a contact element.

DE 20 2007 005 133 U1 and DE 199 00 995 A1 are additionally named with respect to the prior art.

SUMMARY OF THE INVENTION

Proceeding from the above-mentioned prior art, the invention is therefore based on the problem of indicating an improved electromagnetic actuating device, optimized with regard to adhesion force, which is distinguished by an increased wear resistance and which preferably manages with a comparatively small—i.e. optimized with regard to installation space—, stationary coil device. The object further consists in indicating a camshaft adjustment device with a correspondingly improved electromagnetic actuating device.

This problem is solved with regard to the electromagnetic actuating device by the features disclosed herein and also with regard to the camshaft adjustment device by the features disclosed herein. Advantageous further developments of the invention are also indicated. All combinations of at least two of the features disclosed in the description, the claims and/or the figures fall within the scope of the invention.

The invention has identified that the wear resistance can be increased by a suitable choice of material of the core region, wherein initially the problem still exists that harder core region material is generally poorly magnetically flux-conducting, which with a construction of the core body from a hardened material would lead to extremely poor efficiencies up to the point of the electromagnetic actuating device being incapable of functioning. The configuration or respectively improvement according to the invention of an electromagnetic actuating device according to the invention has a way out from this dilemma, in which the core region is not constructed in one part, as in the prior art, by rather in several parts and has a core body which is preferably readily conductive magnetically, and a contact element fixed in this core body, preferably projecting over the core body in the direction of the armature, which contact element is distinguished by an increased hardness compared with the core body, preferably measured in HRC. In other words, the invention initially accepts a construction of the core region in several parts, which at first sight is disadvantageous, and can hereby surprisingly achieve a number of advantages. On the one hand, in a comparatively simple manner the abutment surface or respectively the contact surface encumbered with oil between the core region and the actuating member can be influenced by a corresponding adaptation of the contact element geometry, without it being necessary for this to additionally adapt the core body geometrically. At the same time, on the other hand, despite increased surface pressure owing to the reduction in contact area to avoid the adhesion force, the wear resistance of the core region is increased, because the actuating member rests in a switching position against the contact element, which is harder compared with the core body. In particular when a hardened material, in particular a hardened steel, such as for example 16MnCr5, is used as material for the construction of the contact element, the field line course of the magnetic field lines in the core body surrounding the contact element in sections is influenced in a targeted manner, in particular bundled in a preferably annular region adjacent to the contact element, whereby the efficiency of the electromagnetic actuating device is increased, whereby in turn a smaller dimensioned coil device (optimized with regard to installation space) can come into use.

The air gap which is preferably constructed between the permanent magnet means, preferably present as part of a disc pack, or a pole disc on the armature side, and the core body, can be set by means of the, preferably pressed in, contact element with a defined overlap over the core body to effect a force maximum (apex), i.e. the air gap can be set or respectively optimized with regard to a maximum repulsion force, whereby minimal switching times are able to be achieved.

Basically it is possible that the actuating member in the above-mentioned switching position in addition to the contact element fixed in the core body rests against the core body, i.e. that the contact surface on the core region side is formed only in sections or respectively partially by the contact element. However, an embodiment is preferred in which the contact surface on the core region side is formed exclusively by the contact element, in order on the one hand to achieve as small a contact surface as possible and hence as low adhesion forces as possible, and in order on the other hand to optimize the wear resistance of the electromagnetic actuating device, in particular the core region, as a whole. It is particularly preferred if the contact surface formed by the contact element is arranged concentrically with respect to a longitudinal centre line of the actuating member. Advantageously, the contact element projects here over the pole surface of the core body facing the permanent magnet means.

Basically, it is possible to construct the contact element from a material which offers the magnetic flux the same, or even a lower resistance, as the material of the core body. However, it is preferred, as explained in the introduction, if the magnetic conductivity of the contact element is poorer than that of the core body surrounding it, in order to bundle the field lines in a targeted manner. By means of the preferably pressed in contact element, therefore a bundling of the magnetic field lines is achieved, which brings it about that the field lines are "steered" in a more targeted manner to the oppositely directed field lines from the permanent magnet means. Therefore, an optimization of the repulsion force and hence a minimal switching time can be achieved.

It is particularly expedient if the hardness of the material of the contact element, preferably indicated in HRC, is at least twice as great, preferably at least three times as great, still further preferably at least four times as great as the hardness of the core body material. This can be achieved for example in that the core body is constructed from the steel alloy 11SMn30 and the, preferably pin-shaped, contact element is constructed from the alloy 16MnCr5. In this case, the core body has a hardness of approximately 10 HRC and the contact element a hardness of approximately 60 HRC.

In order to reduce or respectively optimize the adhesion forces between the contact surface on the core region side and the contact surface on the actuating member side, provision is made in a further development of the invention that the contact surface on the core region side is smaller than a surface (cross-sectional area) of the actuating member extending radially to the longitudinal extent of the actuating member, in particular than the end side (end face) of the actuating member facing the core region and/or the cross-sectional area of the actuating member surrounded by the permanent magnet means. It is especially preferred if the contact surface on the core region side, which is preferably formed exclusively by the contact element, corresponds to only maximally 70%, preferably maximally 60%, more preferably maximally 50%, still more preferably maximally 40% of this area. Particularly good results can be achieved here when the diameter of the preferably cylindrical contact surface on the core region side, formed by the contact element, is selected from a range of values between 2 mm and 8 mm, preferably between 4 mm and 7 mm, particularly preferably approximately 5.2 mm.

In order to be able to precisely set the air gap, defined by the contact element, between the core body and the actuating member and/or the permanent magnet means and/or a pole disc arranged on the permanent magnet means, provision is advantageously made in a further development of the invention that a, preferably annular, axial stop surface is provided on the contact element, by which the contact element, fixed in the core body, rests axially against the core body. In an embodiment without an axial stop surface on the contact element, the air gap can be set for example via the setting of a (then variable) axial pressing-in depth of the contact element, wherein in this case it is to be ensured that the press fit between contact element and core body is selected so that also during operation an axial travel of the contact element into the core body and an air gap reduction related thereto during the operation is avoided. Additionally or alternatively to a press fit, the contact element can be fixed to the core body via an axial and/or radial deformation of the core body material (peening).

It is especially expedient if the contact element is received in an end-side bore of the core body and is fixed there preferably by means of a press fit. In other words, in a further development of the invention the contact element is introduced into a bore of the core body.

It is particularly expedient here if the bore is not realized as a continuous cylinder bore (which is alternatively possible), but rather as a stepped bore with at least one annular shoulder, which preferably forms an axial counter stop surface for an axial stop surface of the contact element. It is still further preferred here if the press fit is realized in a rear or respectively lower bore section in relation to the actuating member. An axial pin pressing of approximately 2 mm to 4 mm, preferably of 3 mm is preferably realized here.

It has been found to be particularly expedient if the contact surface formed by the contact element is smaller than the maximum bore diameter of the bore, i.e. in the case of the construction of the bore as a stepped bore is smaller than a front bore diameter or respectively is smaller than an external diameter of an annular axial stop surface. Particularly preferably, the contact surface formed by the contact element corresponds to a cross-sectional area of the contact element in the pressing-in region. It is especially preferred if the free end of the contact element is constructed so as to be convex—in other words, a convexity of the contact surface offered by the contact element is advantageous, because the actuating element as part of the armature assembly in the drawn-in state by a radial preferred position occurring owing to the convexity can become jammed less on the edge of the contact element.

As already mentioned in the introduction, it is particularly preferred if the contact element projects over the core body in axial direction, i.e. in the direction of the actuating element. In a further development of the invention, provision is now made that this axial overlap is selected so that with a given current feed of the coil winding a force maximum of the repulsion force results between core body and permanent magnet means. If the axial overlap is selected to be too great, this leads to a loss of force in the effective magnetic forces—if the axial overlap is selected to be too small, this means increased adhesion forces and hence a loss of force in the resulting repulsion force. Preferably, the axial overlap is selected here so that the resulting air gap leads to a maximum repulsion force plus/minus 20%, preferably plus/minus 10%, still further preferably plus/minus 5%.

The invention also specifies a camshaft adjustment device with an electromagnetic actuating device, constructed according to the concept of the invention, as actuator for realizing the adjustment movement of the camshaft or respectively of its cams.

BRIEF DESCRIPTION OF THE DRAWINGS

Further advantages, features and details of the invention will emerge from the following description of preferred example embodiments and with the aid of the drawings.

These show in.

DETAILED DESCRIPTION

In the figures, identical elements and elements with the same function are marked by the same reference numbers.

Figure 1:
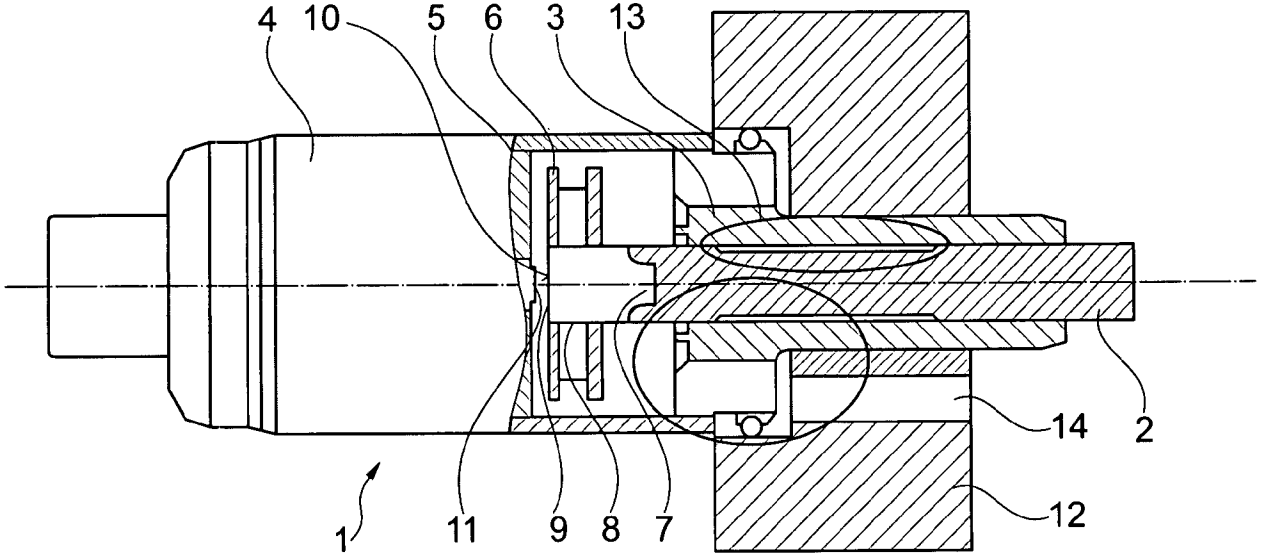
FIG. 1: a view, partially in section, of a possible embodiment of an electromagnetic actuating device constructed according to the concept of the invention, in which the contact surface on the core region side is formed by a contact element fixed in a core body.
Figure 2:
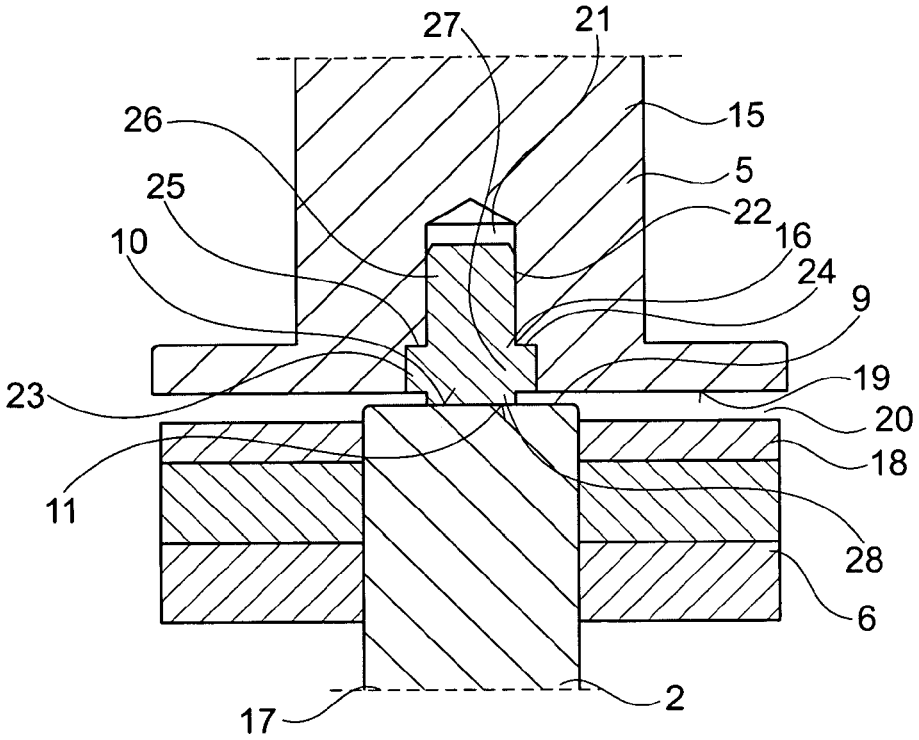
FIG. 2: a detail illustration of a possible embodiment of a combination of core region and armature.
Figure 3:
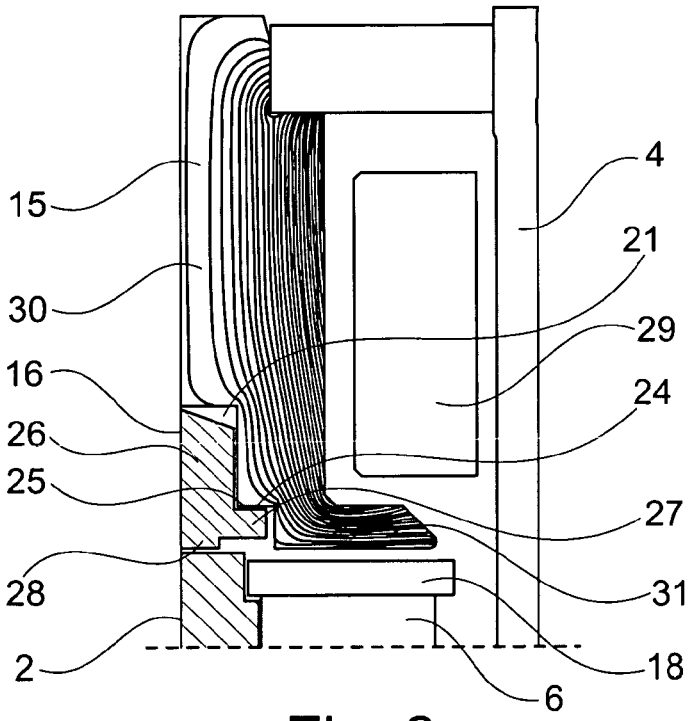
FIG. 3: an illustration of the optimized field line course by the use of a magnetically more poorly conducting contact element.

FIG. 1 shows the realization of an electromagnetic actuating device for a camshaft adjustment device which is otherwise not illustrated in further detail. A possible variant configuration of the combination of core region and armature is illustrated in FIGS. 2 and 3.

The camshaft, which is not illustrated, is actuated directly or indirectly with the aid of a continuously elongated, bolt-shaped actuating member 2, which in addition to permanent magnet means 6, which are to be further explained later, is a component part of the armature. The actuating member 2 is guided adjustably in axial direction in a sleeve-shaped bearing element 3, which undertakes at the same time the function of a magnetic yoke. The electromagnetic actuating device 1 comprises, within a cup-shaped housing 4, a coil device, known per se, not illustrated in FIG. 1, to which a magnetic core region 5 is associated. With the aid of the coil device, the actuating member 2 with the permanent magnet means 6 fixed thereon can be adjusted in the axial direction, wherein on the end side of the actuating member 2, facing away from the core region 5, an engagement region is constructed, in order to cooperate with a counterpart, in particular with the camshaft. Alternatively, the engagement region can also be provided on the shell side.

As previously indicated, permanent magnet means 6 are associated with the actuating member 2, which in the example embodiment shown according to FIG. 1 have the form of a cylinder disc. These sit on the shell surface 7, i.e. on the shell side, of a front cylindrical section of the actuating member 2. The latter penetrates a cylindrically contoured, central cut-out 8 of the permanent magnet means 6. These are fixed to the actuating member 2 in a materially connected and/or form-fitting manner, for example by welding. The permanent magnet means 6, with a coil device not fed with current, serve to keep the actuating member 2 in the illustrated switching position (on the left in the plane of the drawing), in which the actuating member rests with an end side 9, more precisely with a contact surface 10 constructed thereon on the actuating member side, on a contact surface 11 parallel thereto on the core region side. By feeding the coil device with current, the permanent magnet means 6 are repelled and the actuating member 2 together with these are adjusted into a second switching position, to the right in the plane of the drawing.

As can be seen in FIG. 1, the electromagnetic actuating device 1 is held in an engine block 12, which is only shown in part. Here, an inlet- and/or discharge duct 13 for liquid lubricant, here engine oil, is formed in the bearing element 3. A further duct 14 for the lubricant is situated radially offset to the inlet- and discharge duct 1 within the engine block 12.

As indicated in FIG. 1 and will be explained by way of example by means of FIGS. 2 and 3, the core region 5 is constructed in several parts and comprises a core body 15 of material with good conductivity magnetically, in the actual example embodiment of a steel alloy 11SMn30 with a hardness of 10 HRC. A contact element 16, forming the contact surface 11 on the core region side, is fixed in this core body 15 by pressing, wherein the contact element 16 is constructed from a material, here the steel alloy 16MnCr5, which has a distinctly greater hardness of 60 HRC here than the core body 15.

In FIG. 2 the combination of armature 17 with elongated actuating member 2 and core region 5 is illustrated in accordance with a preferred variant embodiment. The construction in multiple parts can be seen, here in two parts, of the core region 5, which comprises the core body 15 with contact element 16 fixed therein, which forms the contact surface 11 on the core region side, which cooperates with a contact surface 10 of corresponding size on the actuating member side in the illustrated switching position, i.e. lies against it.

The structure of the armature 17 can be seen from FIG. 2. Permanent magnet means 6 in the form of two permanent magnet discs are fixed on the cylindrical actuating element 2 (actuating member) of the armature 17. Associated with the permanent magnet means 6 is a pole disc 18 which is also penetrated by the actuating member 2. The pole disc 18 is oriented parallel to a corresponding opposite pole surface 19 of the core body 15. A working air gap 20, partially or completely filled with oil, is formed between pole disc 18 and pole surface 19. The width of this working air gap 20 is substantially defined by the extent by which the contact element 16 projects over the pole surface 19 of the core body 15 in the direction of the actuating member 2. In addition, the working air gap 20 is determined by the axial distance between the annular pole surface of the pole disc 18, facing the pole surface 19, and the end side 9 of the actuating member 2.

As can be seen from FIG. 2, on the end side in the core body 15 a bore 21 is introduced, constructed as a stepped bore, which is divided into a rear, cylindrical section 22 with reduced diameter (press-in section) and a front section 23 with widened diameter, the base of which forms a counter stop surface 24 for an annular axial stop surface 25 of the contact element 16. The actual press fit between the contact element 16 and the bore 21 is realized (exclusively) in the section 22 with reduced diameter, whereas the section 23 with widened diameter substantially only has as a function the formation of the counter stop surface 24 (i.e. a radial play is possible there).

For the form-fitting receiving of the contact element in the bore 21, embodied as a stepped bore, the contact element 16 according to the illustrated preferred variant embodiment has a lower cylinder section 26 with reduced diameter and a cylinder section 27 with widened diameter axially adjoining thereto, which projects over the cylinder section 26 with reduced diameter by means of a peripheral collar, on which the axial stop surface 25 is constructed on the side facing away from the actuating member 2. In the example embodiment which is shown, a cylindrical contact surface section 28 adjoins the cylinder section 27 with widened diameter, which cylindrical contact surface section 28 in the example embodiment which is shown has a diameter which corresponds to the diameter of the section 26 with reduced diameter, but if required can, however, also deviate herefrom. A variant embodiment is also conceivable in which the contact surface section 28 is formed by an axially extended cylinder section 27 with widened diameter.

It is also able to be realized, for the case where an axial stop surface 25 is to be dispensed with, to construct the contact element in pin form, for example in the form of a circular cylinder, wherein then preferably the bore 21 is not embodied as a stepped bore, but rather as a continuously cylindrical bore.

As can be seen from FIG. 2, in the example embodiment which is shown the contact surface 11 on the core region side is substantially smaller than the end side 9 of the actuating member. In the example embodiment which is shown, the surface extent of the end face 9 corresponds, at least approximately, to the surface extent of the cross-sectional area of the actuating member 2, which is surrounded by the permanent magnet means 6.

In FIG. 3 there is an alternative representation of a cut-out of an electromagnetic actuating device illustrated by way of example in FIG. 1. The core body 15 can be seen, in which the contact element 16 is fixed, and namely as in the example embodiment according to FIG. 2 in a cylinder bore 21, which provides a counter stop surface 24 for the contact element. In the example embodiment according to FIG. 3, the cross-sectional area of the cylindrical contact surface section 28 is smaller than that of the cylinder 26 with reduced diameter, which in turn is smaller than that of the cylinder section 27 with widened diameter, on which the axial stop surface 25 is constructed for the cooperation of the counter stop surface 24 of the core body 15.

As can be further seen from FIG. 3, the core body 15 is surrounded by a coil device 29, illustrated only diagrammatically, for generating the magnetic field 30 which is illustrated partially in the form of field lines. It can be seen that the bore 21 with the contact element 16 received therein displaces the field lines radially outwards and therefore bundles in a region 31 of the core body 15 radially adjacent to the contact element 16, in order to thus intensify the magnetic force between core body 15 and pole disc 18 in this region.

Figure 4:
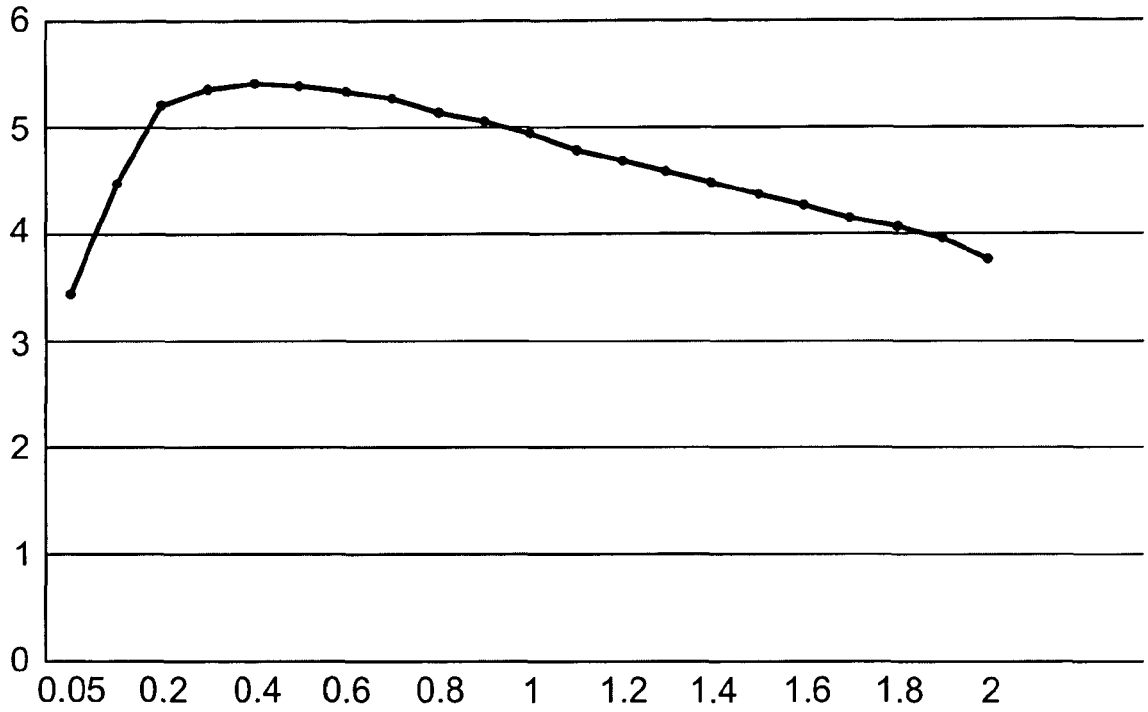
FIG. 4: a diagram which can be consulted for the design of the air gap and hence of the axial overlap of the contact element over the core body, in order to ensure a maximum repulsion force.

In FIG. 4 a diagram is shown, which shows the correlation between the repulsion force acting on the armature assembly and the width of the air gap, shown in FIG. 2, between the core body 15 and the pole disc 18 (alternatively the permanent magnet means directly). Here, on the vertical axis the repulsion force is indicated in Newtons and on the horizontal axis the width of the air gap is indicated in millimetres. The repulsion force is the difference between the magnetic repulsion force and the adhesion force. It can be seen that in the example a repulsion force maximum exists with an air gap width of approximately 0.4 mm. When the air gap is selected to be smaller, the adhesion forces increase in an extreme manner, so that despite increasing magnetic forces the repulsion force decreases. On the other hand, the magnetic repulsion force and hence the resulting repulsion force likewise decreases with a further increasing air gap width. The axial overlap of the contact element 16 over the core body 15 is therefore preferably selected in the example embodiment shown so that the resulting air gap has a width of at least approximately 0.4 mm in the switching position in which the actuating element 2 lies against the contact element.

Figure 5:
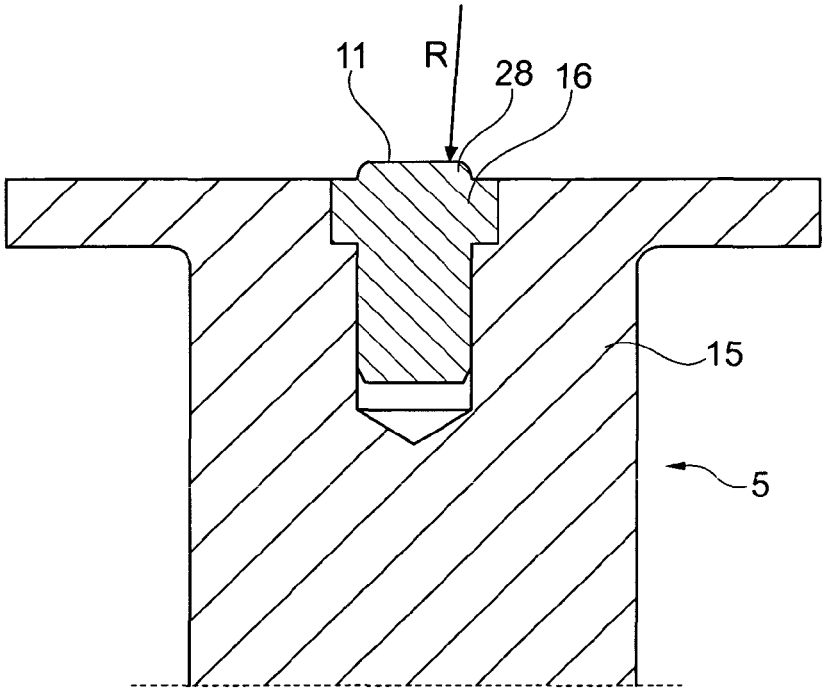
FIG. 5: the illustration of an example embodiment with convex contact surface on the contact element side.

FIG. 5 shows an example embodiment of a core region 5, preferably coming into use. The contact element 16, provided in the core body 15, can be seen, which contact element projects over the core body 15 in axial direction. It can further be seen that the contact surface 11 on the core region side is embodied so as to be slightly convex, wherein the radius determining the convexity corresponds to a multiple of the diameter of the front contact surface section 28, which is preferred.

Through this convexity, a radial preferred position of the actuating element 2 can occur on the contact element, whereby a jamming on a contact element edge is reliably prevented.

The invention claimed is:

1. An electromagnetic actuating device (1) for a camshaft adjustment device of an internal combustion engine of a motor vehicle, comprising an elongated actuating element (2) forming an engagement region on an end side and movable by a force of a coil device (29) provided in a stationary manner, which elongated actuating element has in parts a cylindrical covering contour and penetrates a cut-out (8) in permanent magnet means (6) arranged on a shell side, which are constructed for cooperating with a stationary core region (5) comprising a core body (15), and which elongated actuating element lies in a switching position with a contact surface (10), on the end side on an elongated actuating element side, against a contact surface (11) on a core region side, wherein the contact surface (11) on the core region side is formed at least in part by a contact element (16) fixed in the core body (15), which contact element is constructed from a material which has a greater hardness than the material of the core body (15).

2. The actuating device according to claim 1, wherein the contact surface (11) on the core region side is formed completely by the contact element (16).

3. The actuating device according to claim 1, wherein the contact element (16) has a greater magnetic flux resistance than the core body (15), in order to concentrate the magnetic flux in a region (31) adjacent to the contact element (16).

4. The actuating device according to claim 3, wherein the region (31) is a cross-sectionally annular region.

5. The actuating device according to claim 1, wherein the hardness of the material of the contact element (16), indicated in HRC, is at least twice as great, advantageously at least three times as great as the hardness of the material of the core body (15).

6. The actuating device according to claim 5, wherein the hardness of the material of the contact element (16) is at least three times as great as the hardness of the material of the core body (15).

7. The actuating device according to claim 5, wherein the hardness of the material of the contact element (16) is at least four times as great as the hardness of the material of the core body (15).

8. The actuating device according to claim 1, wherein the contact surface (11) on the core region side is smaller than a cross-sectional area of the elongated actuating element (2), wherein the contact surface (11) on the core region side corresponds to only maximally 70% of this cross-sectional area.

9. The actuating device according to claim 8, wherein the contact surface (11) is smaller than a cross-sectional area of the end side of the elongated actuating element (2) facing the core region (5) and/or the cross-sectional area of the elongated actuating element (2) surrounded by the permanent magnet means (6).

10. The actuating device according to claim 8, wherein the contact surface (11) on the core region side corresponds to only maximally 60% of the cross-sectional area.

11. The actuating device according to claim 8, wherein the contact surface (11) on the core region side corresponds to only maximally 50% of the cross-sectional area.

12. The actuating device according to claim 8, wherein the contact surface (11) on the core region side corresponds to only maximally 40% of the cross-sectional area.

13. The actuating device according to claim 1, wherein the contact element (16) rests with a stop surface axially against the core body (15).

14. The actuating device according to claim 1, wherein the contact element (16) is received in a bore (21) of the core body (15) on an the end side.

15. The actuating device according to claim 14, wherein the bore (21) is constructed as a stepped bore and forms a step of the bore (21) as an axial counter stop surface (24) for the contact element (16).

16. The actuating device according to claim 14, wherein the contact surface formed by the contact element (16) is smaller than the maximum bore diameter of the bore.

17. The actuating device according to claim 14, wherein the contact element (16) is held in the bore (21) by means of a press fit and/or is fixed by axial or radial peening of the core body (15) thereon.

18. The actuating device according to claim 1, wherein the contact element (16) has an end side (9) contoured in a convex manner, forming the contact surface (10) on the elongated actuating element element side.

19. The actuating device according to claim 1, wherein the contact element (16) projects axially over the core body (15) to such an extent that a resulting air gap (20) between the permanent magnet means (6) and the core body (15) is so wide that with a given current feed of the coil device (29) a repulsion force between the permanent magnet means (6) and the core body (15) is at least maximum.

20. A camshaft adjustment device for adjusting a camshaft in an internal combustion engine with an electromagnetic actuating device according to claim 1.

* * * * *